US009616973B2

(12) United States Patent
Rosén

(10) Patent No.: US 9,616,973 B2
(45) Date of Patent: Apr. 11, 2017

(54) MARINE HULL AND MARINE VESSEL

(71) Applicant: Håkan Rosén, Gävle (SE)

(72) Inventor: Håkan Rosén, Gävle (SE)

( * ) Notice: Subject to any disclaimer, the term of this patent is extended or adjusted under 35 U.S.C. 154(b) by 75 days.

(21) Appl. No.: 14/391,882

(22) PCT Filed: Mar. 27, 2013

(86) PCT No.: PCT/SE2013/050344

§ 371 (c)(1),
(2) Date: Oct. 10, 2014

(87) PCT Pub. No.: WO2013/154484

PCT Pub. Date: Oct. 17, 2013

(65) Prior Publication Data

US 2015/0344107 A1 Dec. 3, 2015

(30) Foreign Application Priority Data

Apr. 11, 2012 (SE) ..... 1250361

(51) Int. Cl.
*B63B 3/36* (2006.01)
*B63B 43/18* (2006.01)
(Continued)

(52) U.S. Cl.
CPC ..... *B63B 3/36* (2013.01); *B63B 3/26* (2013.01); *B63B 43/18* (2013.01); *B63B 3/32* (2013.01)

(58) Field of Classification Search
CPC ..... B63B 3/10; B63B 2003/145; B63B 3/20; B63B 3/22; B63B 3/24; B63B 3/26;
(Continued)

(56) References Cited

U.S. PATENT DOCUMENTS 1,294,920 A 2/1919 Lemiszczak
2,077,729 A 4/1937 Wilcox
(Continued)

FOREIGN PATENT DOCUMENTS

JP S47028685 11/1972
JP S48024486 3/1973
(Continued)

OTHER PUBLICATIONS

Extended European Search Report for European Application No. 13775661.5-1751 dated Feb. 29, 2016.
(Continued)

*Primary Examiner* — Ajay Vasudeva
(74) *Attorney, Agent, or Firm* — RatnerPrestia

(57) ABSTRACT

A marine hull including a hull plate manufactured from metal, a set of longitudinal reinforcements and a set of transverse reinforcements, at least one longitudinal reinforcement of the set of longitudinal reinforcements being arranged between the hull plate and at least one transverse reinforcement of the set of transverse reinforcements, and being connected to an inside of the hull plate. The marine hull is characterized in that the hull plate has a thickness that is less than 10 mm, and that the at least one longitudinal reinforcement is manufactured from the same metal as the hull plate and comprises at least one resilient segment arranged to spring in the direction transverse to the thickness of the hull plate, and that the resilient segment is arranged to bottom upon a compression that is more than 10 mm and less than 50 mm.

20 Claims, 4 Drawing Sheets

(51) Int. Cl.
*B63B 3/26* (2006.01)
*B63B 3/32* (2006.01)

(58) Field of Classification Search
CPC ..... B63B 2003/265; B63B 3/28; B63B 3/30; B63B 3/32; B63B 3/34; B63B 3/36; B63B 3/60; B63B 3/62; B63B 39/005; B63B 43/18
USPC .... 114/13, 65 R, 72–74 A, 79 R–79 W, 279, 114/355, 356
See application file for complete search history.

(56) References Cited

U.S. PATENT DOCUMENTS

| | | | | |
|---|---|---|---|---|
| 4,215,645 | A * | 8/1980 | Moeller | B63B 3/20 114/219 |
| 4,254,727 | A * | 3/1981 | Moeller | B63H 21/305 114/65 R |
| 4,453,489 | A | 6/1984 | Charlins | |
| 5,477,797 | A * | 12/1995 | Stuart | B63B 3/20 114/125 |
| 5,542,365 | A | 8/1996 | Jurisich | |
| 6,050,208 | A | 4/2000 | Kennedy | |
| 8,449,967 | B2 | 5/2013 | Mertes | |
| 2008/0095655 | A1 | 4/2008 | Webb | |

FOREIGN PATENT DOCUMENTS

| | | | | |
|---|---|---|---|---|
| JP | H05042680 | | 2/1993 | |
| JP | H07008189 | | 1/1995 | |
| JP | H07076294 | | 3/1995 | |
| JP | 08230775 | A * | 9/1996 | |
| JP | H08230775 | | 9/1996 | |
| JP | H08301180 | | 11/1996 | |
| JP | 2002514532 | | 5/2002 | |
| JP | 2002532326 | | 10/2002 | |
| JP | 2003512951 | | 4/2003 | |
| JP | 2003170889 | | 6/2003 | |
| JP | 2004314825 | | 11/2004 | |
| JP | 2005213628 | A * | 8/2005 | |
| JP | 2005306181 | | 11/2005 | |
| JP | 2008110739 | | 5/2008 | |
| JP | 2008533296 | | 8/2008 | |
| JP | 2009248915 | | 10/2009 | |
| NL | EP 0799764 | A1 * | 10/1997 | B63B 3/20 |
| WO | 9210396 | | 6/1992 | |
| WO | 0035746 | | 6/2000 | |
| WO | 0112499 | | 2/2001 | |

OTHER PUBLICATIONS

International Search Report for PCT/SE2013/050344 mailed Jun. 13, 2013.
Japanese Office Action for Japanese Application No. 2015-505681, mailed Oct. 3, 2016, 5 pages.

* cited by examiner

MARINE HULL AND MARINE VESSEL

CROSS-REFERENCE TO RELATED APPLICATIONS

This application is a U.S. National Phase Patent Application of PCT Application No. PCT/SE2013/050344, filed Mar. 27, 2013, which claims priority to Swedish Patent Application No. 1250361-1, filed Apr. 11, 2012, each of which is incorporated by reference herein in its entirety.

TECHNICAL FIELD OF THE INVENTION

The present invention relates generally to a marine hull manufactured from metal in the form of a lightweight structure for marine vessels. In particular, the present invention relates to a marine hull comprising a hull plate manufactured from metal, a set of longitudinal reinforcements and a set of transverse reinforcements. At least one longitudinal reinforcement of said set of longitudinal reinforcements is arranged between the hull plate and at least one transverse reinforcement of said set of transverse reinforcements, and is connected to an inside of the hull plate. In a second aspect, the present invention relates to a marine vessel comprising such a marine hull.

BACKGROUND OF THE INVENTION AND PRIOR ART

According to tradition and custom, the hull of marine vessels having requirements of low weight, such as planing boats for private, civilian, or military use, is manufactured from aluminium or plastic. However, large (greater than 10 m) as well as small (less than 10 m) boats of such a lightweight structure are impaired by certain disadvantages. A large disadvantage of plastic boats is that they are relatively fragile in relation to size and weight, and thereby the hull risks cracking in heavy groundings or if the boat bumps into cliffs upon mooring in natural harbour. Another disadvantage of plastic boats is that they require much care and maintenance, for instance cleaning, under water painting, waxing, polishing, etc., to prevent the plastic from ageing and crackling. However, the ageing of the plastic cannot entirely be prevented and the air, the water, UV radiation, and aquatic organisms deteriorate the properties of the plastic already after a few years. Marine hulls of plastic have relatively large tolerances, approximately ±1% in length and width, as well as are not stable in shape; this entails expensive and highly time-consuming fitting work of the fixtures and other structures of the marine vessel. A large disadvantage of boats manufactured from light metal, such as aluminium, is that the hulls of these boats have to be welded together from several panels, generally single-curved panels, which limits the hydrodynamic properties of the marine vessel. The joints, or the welding seams, between the panels are the weak point of the hull, and not rarely cracks and leaks arise in the welding seams solely because of external stress from the water upon propulsion of the boat. The welding seams also risk cracking upon grounding or the like. Aluminium boats also have the disadvantage that, in course of time, a total fatigue of the material occurs. In addition, boats of light-metal hulls easily buckle due to external stress, because the hull plate has a low buckling load limit at the same time as the framework, or set of longitudinal reinforcements and transverse reinforcements, of the boat that carries the hull plate is entirely rigid and non-compliant. These deformations imply not only an aesthetic problem but also a hydrodynamic problem, with decreasing maximum speed and manoeuvrability as a consequence. Similar to marine hulls manufactured from plastic, marine hulls manufactured from aluminium also have relatively large tolerances, approximately ±1% in length and width, which entails expensive and highly time-consuming fitting work of the fixtures and other structures of the marine vessel.

The hulls of high-speed non-planing or displacement boats, such as high-speed warships like frigates and destroyers, are most often manufactured from joined, thick steel plates. A typical thickness of such hull plates is 15-30 mm, which are interconnected by means of welding. Even if said boats withstand large external stresses, they risk, similar to aluminium boats, getting permanent deformations. Another large disadvantage of this type of steel boats is that they have a great weight in relation to their size and thereby consume much fuel upon propulsion, which makes them less suitable for private use.

BRIEF DESCRIPTION OF THE OBJECTS OF THE INVENTION

The present invention aims at obviating the above-mentioned disadvantages and failings of previously known marine hulls and at providing an improved marine hull. A primary object of the invention is to provide an improved marine hull of the type that is defined by way of introduction and that is of lightweight structure and simultaneously has a large resistance to permanent deformation upon external load/stress.

BRIEF DESCRIPTION OF THE FEATURES OF THE INVENTION

According to the invention, at least the primary object is achieved by means of the marine hull and marine vessel that are defined by way of introduction and have the features defined in the independent claims. Preferred embodiments of the present invention are furthermore defined in the dependent claims.

Thus, according to a first aspect of the present invention, there is provided a marine hull of the type that is defined by way of introduction and characterized in that the hull plate has a thickness that is less than 10 mm, and that the at least one longitudinal reinforcement of the hull is manufactured from the same metal as said hull plate and comprises at least one resilient segment arranged to spring in the direction transverse to the plate thickness of the hull, and that said resilient segment is arranged to bottom upon a compression that is more than 10 mm and less than 50 mm.

According to a second aspect of the present invention, a marine vessel comprising such a marine hull is provided.

Thus, the present invention is based on the understanding that by manufacturing a part of the framework of the hull, at least one longitudinal reinforcement, resiliently, the same will absorb strong external load without the hull plate obtaining permanent deformations.

According to a preferred embodiment of the present invention, the at least one resilient segment of said at least one longitudinal reinforcement is arranged to initiate springing upon an applied external force that corresponds to more than 70% of the buckling load of the hull plate, preferably more than 80%.

According to a preferred embodiment, the at least one resilient segment of said at least one longitudinal reinforcement is arranged to bottom upon an applied external force that corresponds to more than 95% of the buckling load of the hull plate, preferably more than 98%.

Preferably, said at least one longitudinal reinforcement comprises a rigid segment, which is connected to and separates two of said resilient segments. This entails that the longitudinal reinforcement provides the function of a stringer and is simultaneously resilient.

In a further preferred embodiment, the rigid segment of the longitudinal reinforcement is connected to said at least one transverse reinforcement, and wherein each of the two resilient segments of the longitudinal reinforcement is connected to the inside of the hull plate.

Still more preferably, said at least one longitudinal reinforcement comprises a plate having longitudinal bendings, which plate forms at least a part of the rigid segment as well as said two resilient segments.

Additional advantages and features of the invention are seen in the other dependent claims as well as in the following, detailed description of preferred embodiments.

BRIEF DESCRIPTION OF THE DRAWINGS

A more complete understanding of the above-mentioned and other features and advantages of the present invention will be clear from the following, detailed description of preferred embodiments, reference being made to the accompanying drawings, wherein.

DETAILED DESCRIPTION OF PREFERRED EMBODIMENTS

According to a first aspect, the present invention relates to a marine hull, generally designated 1, and according to a second aspect, to a marine vessel comprising such a hull. The hull 1 belongs to the group of lightweight hulls that in particular are suitable for usage in high-speed, planing marine vessels, or boats, even if great advantages also arise in use in high-speed, displacement boats.

Figure 1:
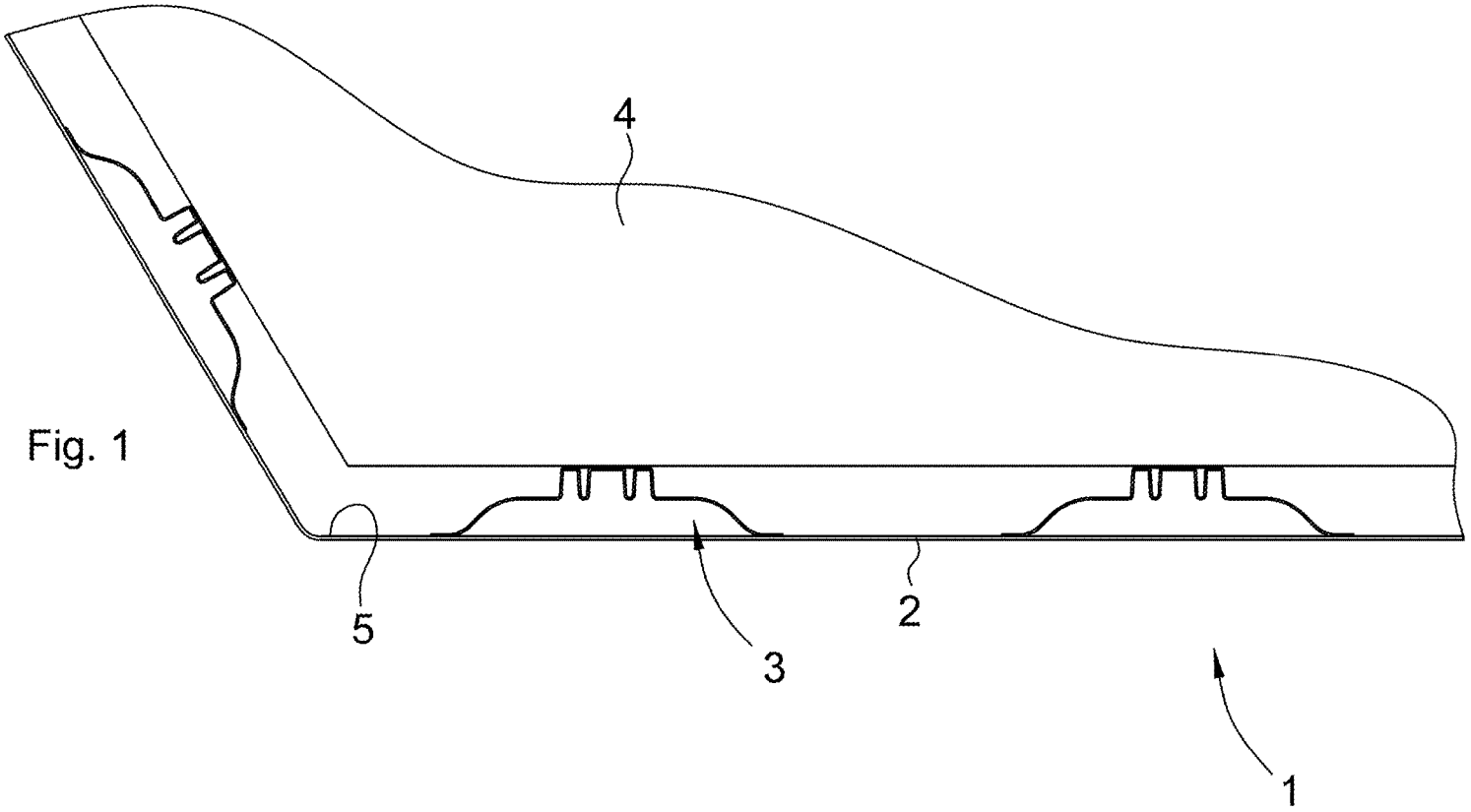
FIG. 1 is a schematic cross-sectional view of a part of the marine hull according to the invention and showing a plurality of longitudinal reinforcements.

Reference is initially made to FIG. 1, in which there is shown a cross-section of a part of the marine hull 1 according to the invention. The hull 1 comprises in the usual way a hull plate 2 manufactured from metal, which may consist of one or more joined segments, as well as a framework that consists of a set of longitudinal reinforcements and a set of transverse reinforcements. The set of longitudinal reinforcements comprises a plurality of longitudinal reinforcements that may have the same or different shape/function, and the set of transverse reinforcements comprises a plurality of transverse reinforcements that may have the same or different shape/function. For instance, each transverse reinforcement 4 may be a transverse frame or a transverse bulkhead.

Said set of longitudinal reinforcements comprises at least one longitudinal reinforcement, generally designated 3, and said set of transverse reinforcements comprises at least one transverse reinforcement 4, said at least one longitudinal reinforcement 3 being arranged between the hull plate 2 and said at least one transverse reinforcement 4. Said at least one longitudinal reinforcement 3 extends entirely or partly from the stem of the hull 1 to the stern of the same, and is connected to an inside 5 of the hull plate 2 as well as to an outside of said at least one transverse reinforcement 4. Preferably, the set of longitudinal reinforcements comprises a plurality of, or solely, longitudinal reinforcements 3 according to the invention.

The set of transverse reinforcements consists of transverse frames or transverse bulkheads, or a mixture thereof, which are stable in shape and thereby give a well-defined interior interface against the fixtures and other structures of the marine vessel.

According to the present invention, the hull plate 2 should be manufactured from metal and have a thickness that is less than 10 mm. Preferably, the hull plate 2 consists of a plurality of segments, which are arranged edge to edge and joined to each other by means of welding/fusion and subsequent heat treatment. The result of this treatment gives a marine hull 1 with a homogeneous structure without weakening joints. The segments of the hull plate 2 are preferably laser cut, based on a data model, so as to obtain the greatest possible accuracy. Furthermore, the segments of the hull plate 2 are preferably compression-moulded by means of hydroforming. The preferred production of the hull plate described above entails that the shape of the hull plate 2 is given a predetermined shape with a very large accuracy, and thereby the need for individual adaption of the fixtures and other components of the marine vessel will decrease markedly, or be entirely eliminated.

Preferably, the thickness of the hull plate 2 is greater than 1 mm, and less than 5 mm. Most preferably, the thickness of the hull plate 2 is less than 3 mm. Preferably, the hull plate 2 is manufactured from a ferrite-austenitic stainless steel, which is corrosion resistant and which is strong as well as ductile, which gives an optimum workability and weldability. Furthermore, the longitudinal reinforcement 3 should be manufactured from the same metal as the hull plate 2, in order to obtain the best possible joining between the hull plate 2 and the longitudinal reinforcement 3, and the best possible function of the invention.

Figure 2:
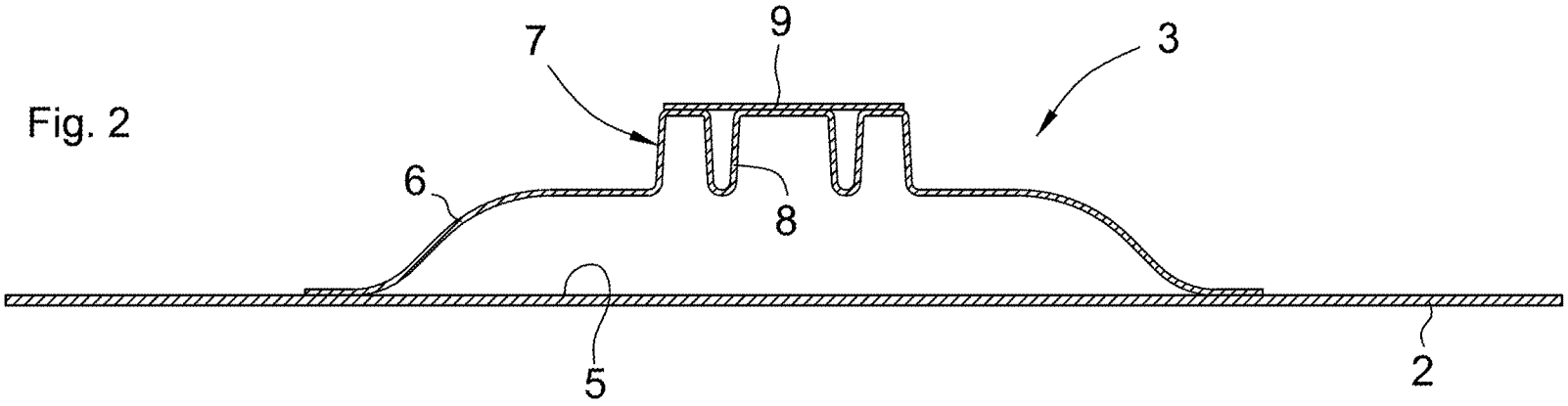
FIG. 2 is a schematic cross-sectional view of a part of the marine hull according to the invention and showing a longitudinal reinforcement according to a first embodiment in an unloaded state.
Figure 3:
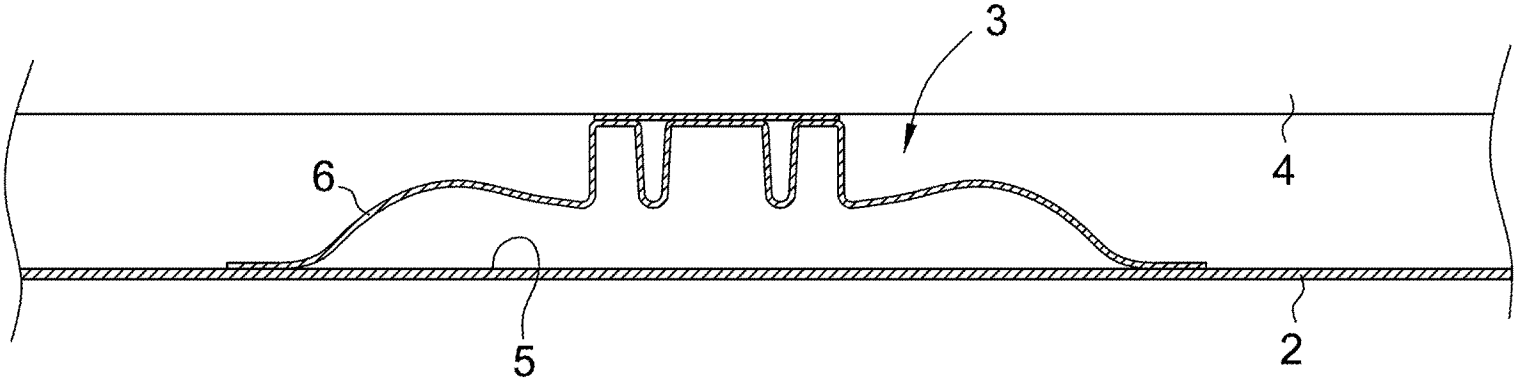
FIG. 3 is a schematic cross-sectional view corresponding to FIG. 2 and showing the longitudinal reinforcement in a partly compressed state.

Reference is made now to FIGS. 2 and 3, in which there is shown a schematic cross-sectional view of a part of the marine hull 1 according to the invention having the longitudinal reinforcement 3 according to a first embodiment in an unloaded and partly compressed state, respectively.

The longitudinal reinforcement 3 comprises at least one resilient segment 6 arranged to spring in the direction transverse to the thickness of the hull plate 2, said resilient segment 6 preferably being longitudinal along the longitudinal reinforcement 3. In the embodiment shown, the resilient element 6 has an extended S-shape. Said resilient segment 6, or the longitudinal reinforcement 3, is arranged to bottom upon a compression that is more than 10 mm and less than 50 mm. In other words, upon an applied external force, the hull plate 2 is pressed inward at the same time as the resilient segment 6 springs to absorb the applied external force and thereby permanent deformation of the hull plate 2 is prevented.

Preferably, the at least one resilient segment 6 of the longitudinal reinforcement 3 is arranged to initiate springing upon an applied external force that corresponds to more than 70% of the buckling load of the hull plate 2, more preferably more than 80%. Furthermore, it is preferred that the at least one resilient segment 6 of the longitudinal reinforcement 3 is arranged to bottom upon an applied external force that corresponds to more than 95% of the buckling load of the hull plate 2, more preferably more than 98%, and most preferably at the same time as the applied external force corresponds to 100% of the buckling load of the hull plate 2. With buckling load, herein reference is made to the load where the hull plate 2 gets permanent deformations/buckles.

The longitudinal reinforcement 3 comprises preferably two resilient elements 6, as well as a rigid segment 7 that is connected to and separates said two resilient segments 6. In other words, the rigid segment 7 is centrally placed, and the longitudinal reinforcement 3 is symmetrical around an imaginary plane that extends parallel to the longitudinal reinforcement 3 and at a right angle in relation to the hull plate 2. The rigid segment 7 provides the function of a traditional stringer. In the preferred embodiment, the rigid segment comprises in cross-sectional a wave-shaped, or serpentine-shaped, plate segment 8 that preferably is connected to a flat strip plate 9. The strip plate 9 is connected to the wave crests of the in cross-sectional wave-shaped plate segment 8, and is accordingly the part of the longitudinal reinforcement 3 that is connected to said at least one transverse reinforcement 4.

Figure 5:
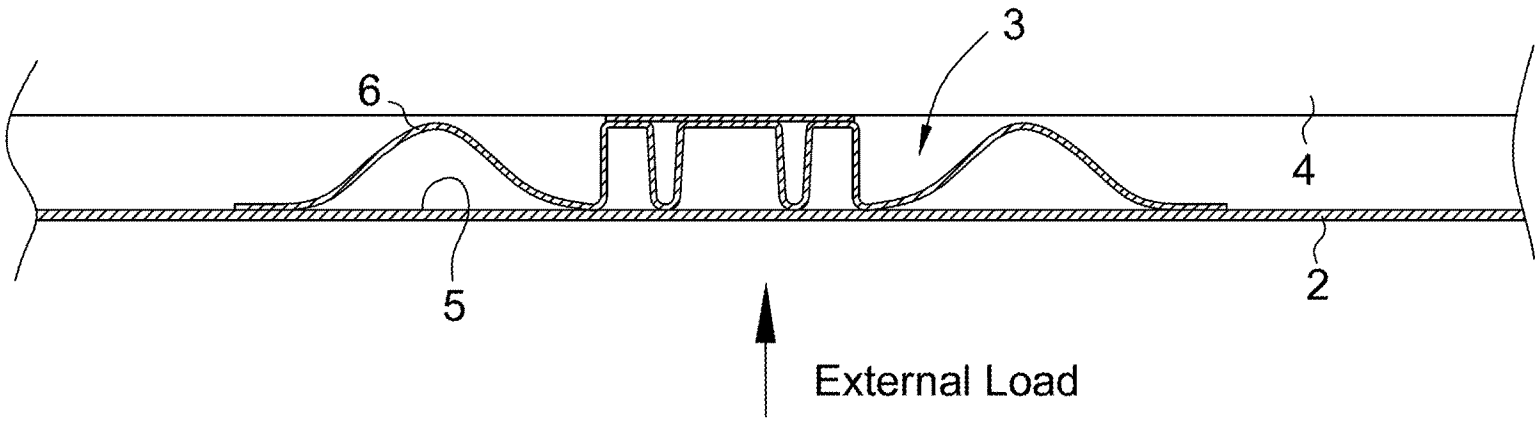
FIG. 5 is a schematic cross-sectional view corresponding to FIG. 2 and showing the longitudinal reinforcement in a fully compressed state, i.e. in a bottom configuration.

The rigid segment 7 of the longitudinal reinforcement 3 is connected to said at least one transverse reinforcement 4, and each of the two resilient segments 6 of the longitudinal reinforcement 3 is connected to the inside 5 of the hull plate 2. Preferably, the longitudinal reinforcement 3 is manufactured from a plate having longitudinal bendings, which plate constitutes the major part of the longitudinal reinforcement 3, i.e., is at least a part of the rigid segment 7 as well as the two resilient segments 6. Preferably, the thickness of the plate that constitutes the longitudinal reinforcement 3 is less than the thickness of the hull plate 2. In the preferred embodiment, the longitudinal reinforcement 3 bottoms when the rigid segment 7 contacts the inside 5 of the hull plate 2, see FIG. 5.

Figure 4:
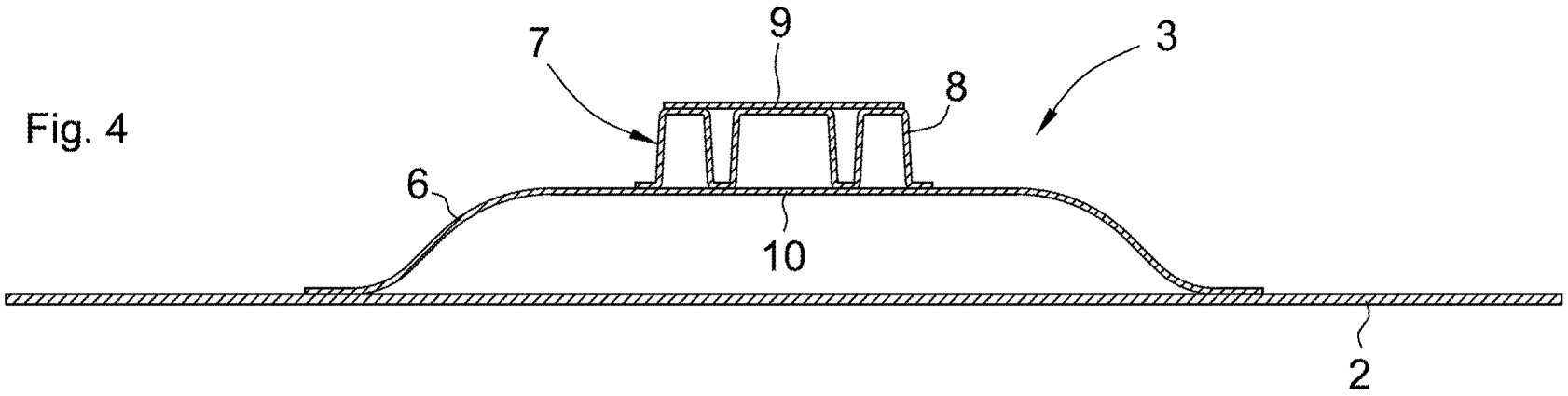
FIG. 4 is a schematic cross-sectional view of a part of the marine hull according to the invention and showing a longitudinal reinforcement according to a second embodiment in an unloaded state.

Reference is now made to FIG. 4, in which an alternative, second embodiment is shown of the longitudinal reinforcement 3 in an unloaded state.

In this embodiment, the rigid segment 7 comprises, in the same way as in the first embodiment, in cross-sectional a wave-shaped, or serpentine-shaped, plate segment 8 that preferably is connected to a flat strip plate 9. However, with the difference that the in cross-sectional wave-shaped plate segment 8 does not constitute part of the plate having longitudinal bendings that is the major part of the longitudinal reinforcement 3. Instead, the two resilient segments 6 are interconnected by means of a straight intermediate section 10, the wave troughs of the in cross-sectional wave-shaped plate segment 8 being connected to said intermediate section 10.

The longitudinal reinforcement 3 should preferably have such a shape that possibly condensation on the inside 5 of the hull plate 2 does not risk being accumulated.

Feasible Modifications of the Invention

The invention is not limited only to the embodiments described above and shown in the drawings, which only have illustrating and exemplifying purpose . This patent application is intended to cover all adaptations and variants of the preferred embodiments described herein, and consequently the present invention is defined by the wording of the accompanying claims and the equivalents thereof. Accordingly, the equipment may be modified in all feasible ways within the scope of the accompanying claims.

It should also be pointed out that all information about/regarding terms such as above, below, upper, under, etc., should be interpreted/read with the equipment orientated in accordance with the figures, with the drawings orientated in such a way that the reference designations can be read in a proper way. Accordingly, such terms only indicate mutual relationships in the shown embodiments, which relationships may be changed if the equipment according to the invention is provided with another structure/design.

It should be pointed out that even if it is not explicitly mentioned that features from one specific embodiment can be combined with the features of another embodiment, this should be regarded as evident when possible.

The invention claimed is:

1. A marine hull comprising a hull plate manufactured from metal, a set of longitudinal reinforcements and a set of transverse reinforcements, at least one longitudinal reinforcement of said set of longitudinal reinforcements being arranged between the hull plate and at least one transverse reinforcement of said set of transverse reinforcements, and being connected to an inside of the hull plate, the hull plate having a thickness less than 10 mm, said at least one longitudinal reinforcement manufactured from the same metal as said hull plate and comprising at least one resilient segment arranged to spring in a direction along the thickness of the hull plate, said resilient segment is connected to said hull plate and arranged to bottom upon a compression that is more than 10 mm and less than 50 mm, wherein said at least one longitudinal reinforcement is connected to said at least one transverse reinforcement, and wherein the at least one resilient segment is arranged to bottom on the hull plate before deformation of the at least one transverse reinforcement.

2. The marine hull according to claim 1, wherein the thickness of the hull plate is more than 1 mm.

3. The marine hull according to claim 2, wherein the thickness of the hull plate is less than 5 mm.

4. The marine hull according to claim 1, wherein the at least one resilient segment of said at least one longitudinal reinforcement is arranged to initiate springing upon an applied external force that corresponds to more than 70% of a buckling load of the hull plate.

5. The marine hull according to claim 1, wherein the at least one resilient segment of said at least one longitudinal reinforcement is arranged to bottom upon an applied external force that corresponds to more than 95% of a buckling load of the hull plate.

6. The marine hull according to claim 1, wherein said at least one longitudinal reinforcement comprises a rigid segment, which is connected to and separates two of said resilient segments.

7. The marine hull according to claim 6, wherein the rigid segment of the longitudinal reinforcement is connected to said at least one transverse reinforcement, and wherein each of the two resilient segments of the longitudinal reinforcement is connected to the inside of the hull plate.

8. The marine hull according to claim 6, wherein said at least one longitudinal reinforcement comprises a plate having longitudinal bendings, which plate forms at least a part of the rigid segment as well as said two resilient segments.

9. The marine hull according to claim 8, wherein the plate of the longitudinal reinforcement has a thickness that is less than the thickness of the hull plate.

10. The marine hull according to claim 1, wherein said at least one transverse reinforcement is a transverse bulkhead.

11. The marine hull according to claim 1, wherein said at least one transverse reinforcement is a transverse frame.

12. The marine hull according to claim 1, wherein the hull plate and said at least one longitudinal reinforcement are manufactured from a ferrite-austenitic stainless steel.

13. The marine hull according to claim 1, wherein the marine hull is of a planing type.

14. The marine hull according to claim 1, wherein the thickness of the hull plate is less than 3 mm.

15. The marine hull according to claim 1, wherein the at least one resilient segment of said at least one longitudinal reinforcement is arranged to initiate springing upon an applied external force that corresponds to more than 80% of a buckling load of the hull plate.

16. The marine hull according to claim 1, wherein the at least one resilient segment of said at least one longitudinal reinforcement is arranged to bottom upon an applied external force that corresponds to more than 98% of a buckling load of the hull plate.

17. A marine vessel comprising a marine hull according to claim 1.

18. A marine hull comprising:

a hull plate manufactured from metal, a set of longitudinal reinforcements and a set of transverse reinforcements, at least one longitudinal reinforcement of said set of longitudinal reinforcements arranged between the hull plate and at least one transverse reinforcement of said set of transverse reinforcements, and connected to an inside of the hull plate, wherein the hull plate has a thickness, said at least one longitudinal reinforcement manufactured from the same metal as said hull plate and comprising at least one resilient segment arranged to spring in a direction along the thickness of the hull plate, said resilient segment arranged to bottom upon a compression that is more than the thickness of the hull plate, wherein said at least one longitudinal reinforcement is connected to said at least one transverse reinforcement, and wherein the at least one resilient segment is arranged to bottom on the hull plate before deformation of the at least one transverse reinforcement.

19. The marine hull according to claim 18, wherein the at least one resilient segment of said at least one longitudinal reinforcement is arranged to initiate springing upon an applied external force that corresponds to more than 70% of a buckling load of the hull plate.

20. The marine hull according to claim 18, wherein said at least one transverse reinforcement is a transverse bulkhead.

* * * * *